US008580051B2

(12) United States Patent
Chin et al.

(10) Patent No.: US 8,580,051 B2
(45) Date of Patent: Nov. 12, 2013

(54) METHOD OF PROCESSING STEEL AND STEEL ARTICLE

(71) Applicants: Herbert A. Chin, Portland, CT (US); William P. Ogden, Glastonbury, CT (US)

(72) Inventors: Herbert A. Chin, Portland, CT (US); William P. Ogden, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/647,461

(22) Filed: Oct. 9, 2012

(65) Prior Publication Data

US 2013/0032251 A1 Feb. 7, 2013

Related U.S. Application Data

(62) Division of application No. 13/083,676, filed on Apr. 11, 2011, now Pat. No. 8,308,873.

(51) Int. Cl.
*C23C 8/22* (2006.01)

(52) U.S. Cl.
USPC ..... 148/319; 148/233; 148/206

(58) Field of Classification Search
USPC ..... 148/233, 206, 319; 420/11, 34
See application file for complete search history.

(56) References Cited

U.S. PATENT DOCUMENTS

| | | | |
|---|---|---|---|
| 3,885,995 | A | 5/1975 | Cunningham |
| 4,568,393 | A | 2/1986 | Kane et al. |
| 5,424,028 | A | 6/1995 | Maloney et al. |
| 5,851,313 | A | 12/1998 | Milam |
| 6,443,624 | B1 | 9/2002 | Knepper et al. |
| 7,186,304 | B2 | 3/2007 | Chin |

OTHER PUBLICATIONS

Corrosion Doctors website, entitled "Stainless Steel Corrosion," http://www.corrosion-doctors.org/MatSelect/corrstainsteel.htm. Mar. 2013.*

Corrosion Doctors website, entitled "Stainless Steel Corrosion," http://www.corrosion-doctors.org/MatSelect/corrstainsteel.htm, 2 pp., Mar. 2013.

* cited by examiner

*Primary Examiner* — Jessee Roe

(74) *Attorney, Agent, or Firm* — Carlson, Gaskey & Olds, P.C.

(57) ABSTRACT

A method of processing steel includes carburizing a martensitic stainless steel work piece to produce a carburized case by utilizing in combination, (i) a composition of the martensitic stainless steel work piece, (ii) a preselected carbon concentration in the carburized case, and (iii) a preselected grain size of the martensitic stainless steel work piece such that the carburized case predominately forms carbides of composition $M_6C$, $M_2C$, $M_{23}C_6$ or combinations thereof. The martensitic stainless steel work piece is then heated to substantially solution the metal carbides. The work piece is then quenched at a cooling rate that is sufficient to avoid substantial precipitation of any carbides during cool down to the martensite start temperature, then given a low temperature temper. In so doing, the carburized case hardened martensitic stainless steel will have balanced mechanical, tribological and corrosion resistance properties for high performance bearing and gear components.

9 Claims, 1 Drawing Sheet

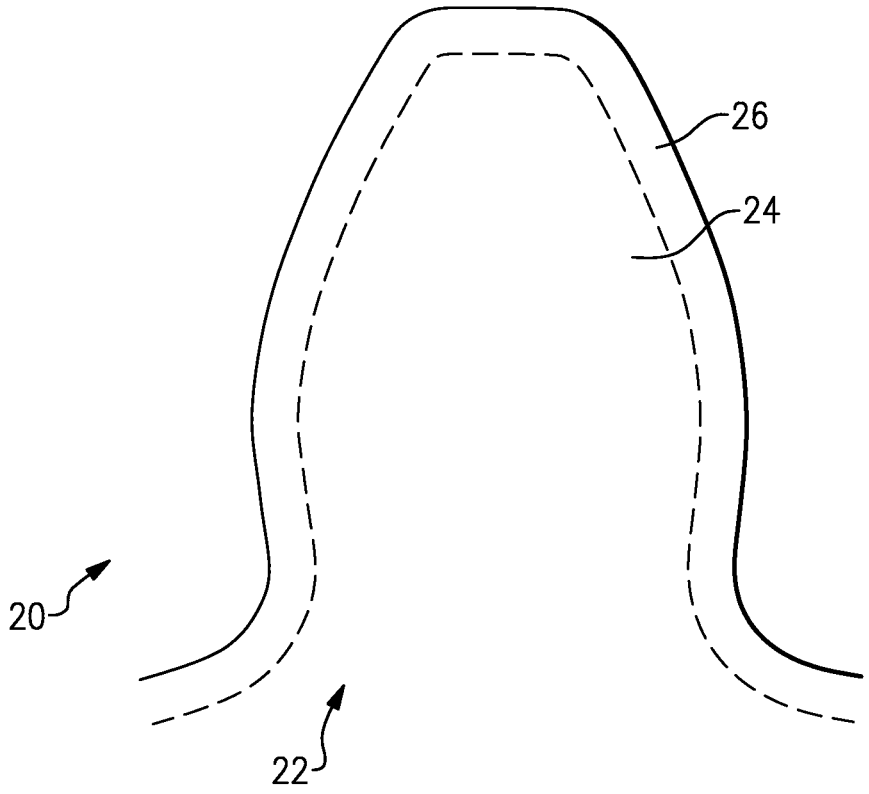
26
24
20
22

METHOD OF PROCESSING STEEL AND STEEL ARTICLE

RELATED APPLICATION

This application is a divisional of U.S. Application No. 13/083,676 filed on Apr. 11, 2011, now U.S. Pat. No. 8,308,873.

STATEMENT REGARDING FEDERALLY SPONSORED RESEARCH OR DEVELOPMENT

This invention was made with Government support under Contract Nos. F33615-01-C-2176, F33615-03-D-2354 0009 and F33615-03-D-2354-0002 awarded by the Department of the United States Air Force. The Government has certain rights in this invention.

BACKGROUND

This disclosure relates to martensitic stainless steels and, more particularly, for a method of processing the steel to achieve balanced mechanical properties and to retain corrosion resistance in the final article.

Stainless steels are generally used and known for their resistance to corrosion. Chromium in the composition of the stainless steel is the primary element responsible for the good corrosion resistance. The chromium is also relatively reactive in the composition and combines with carbon during processing to form chromium carbide compounds at both the grain boundaries and in the body of the alloy grains. Martensitic stainless steels that have relatively low carbon content and high chromium content are particularly vulnerable to forming carbides upon carburization. The formation of the chromium carbide compounds, such as during carburization, depletes the bulk steel matrix of chromium. The addition of carbon in the carburization process generally works to produce a hardened case on a stainless steel part, but the formation of the carbides depletes chromium from the bulk matrix and renders the carburized case substantially less corrosion resistant than the core of the part. The carburization of stainless steel thereby negates the corrosion resistance that is often sought in the use of the stainless steel.

SUMMARY

Disclosed is a method of processing steel that includes carburizing a martensitic stainless steel work piece to produce a carburized case by utilizing in combination, (i) a composition of the martensitic stainless steel work piece, (ii) a preselected carbon concentration in the carburized case, and (iii) a preselected grain size of the martensitic stainless steel work piece such that the carburized case predominately forms carbides of composition $M_6C$, $M_2C$, $M_{23}C_6$ or combinations thereof. The martensitic stainless steel work piece is then heated into the austenite phase region where the metal carbides are substantially solutioned to metal and carbon in the steel matrix. The work piece is then quenched at a cooling rate that is sufficient to avoid substantial precipitation of any carbides during cool down to the martensite start transformation temperature.

In another aspect, the method includes providing the martensitic stainless steel work piece with an amount X wt. % of chromium and an amount Z wt. % of molybdenum in a ratio X/Z that is between 1 and 18. The martensitic stainless steel work piece is then thermo-mechanically processed to produce a grain size of ASTM #5 or smaller. The work piece is then carburized in a suitable furnace with a supply of carbon to form a carburized case that includes less than or equal to 1.75 wt. % carbon and done at a carburization temperature where the steel is in the austenitic condition (face centered cubic—FCC, crystal structure) and can predominately form carbides of composition $M_6C$, $M_2C$, $M_{23}C_6$ or combinations thereof; those skilled in the art will select the temperature and aim carbon content via a multi-component phase diagram or isopleth. Following carburization, the work piece is then heated to a temperature above its austenization temperature to substantially solution the metal carbides to metals and carbon in solution in the FCC austenite phase. The carburized work piece is quenched immediately after austenitization, at a cooling rate that is sufficient to avoid substantial precipitation of any carbides during cool down to the martensite start transformation temperature, such that the carburized case includes at least 8 wt. % chromium in solid solution in the steel matrix.

An exemplary steel article that may be produced by the disclosed methods includes a martensitic stainless steel body that defines a core including at least 8 wt. % chromium and a carburized case that generally surrounds the core. The carburized case includes a greater amount of carbon than the core and also at least 8 wt. % chromium in solid solution.

BRIEF DESCRIPTION OF THE DRAWINGS

The various features and advantages of the disclosed examples will become apparent to those skilled in the art from the following detailed description. The drawings that accompany the detailed description can be briefly described as follows.

FIG. 1 schematically illustrates a cross section of a steel component having a carburized case that generally surrounds a core.

DETAILED DESCRIPTION OF THE PREFERRED EMBODIMENT

FIG. 1 illustrates selected portions of an example steel article 20 having a good balance of mechanical properties, tribological properties and corrosion resistance. As shown, the steel article 20 is a gear (one gear tooth shown in cross-section) but may alternatively be a bearing, shaft, or other steel component that would benefit from this disclosure.

The steel article 20 includes a martensitic stainless steel body 22 that defines a core 24 and a carburized case 26 that generally surrounds the core 24. The carburized case 26 includes a greater amount of carbon than the core 24.

The martensitic stainless steel body 22 may have a composition that consists essentially of 8-18 wt. % chromium, up to 16 wt. % cobalt, up to 5 wt. % vanadium, up to 8 wt. % molybdenum, up to 8 wt. % nickel, up to 4 wt. % manganese, up to 2 wt. % silicon, up to 6 wt. % tungsten, up to 2 wt. % titanium, up to 4 wt. % niobium, and a balance of iron and incidental impurities.

The steel article 20 (i.e., work piece) is produced according to a method of processing that preserves the chromium of the carburized case in solid solution to maintain corrosion resistance of the steel article 20. In other methods of carburizing martensitic stainless steel parts, the introduction of carbon into the surface of the part predominately forms stable carbides, such as MC and $M_7C_3$ (where C is carbon and M is a metal such as chromium, molybdenum, nickel, cobalt, titanium or combinations of these metals), which cannot be eliminated through subsequent heat treatments. The stable carbides thereby cause a depletion of chromium that substantially reduces the corrosion resistance of the part. The "other"

methods/steels referred to, have compositions that preferentially form those undesirable carbides, MC, etc., and underscores the feature of this disclosure for proper martensitic stainless steel selection with alloys elements and ratios describe below whose metallurgical make-up will form the preferred carbides.

Thus, the disclosed method utilizes a preselected composition of the martensitic stainless steel that is favorable for forming targeted kinds of carbides, a preselected carbon concentration in the carburized case 26, and a preselected grain size of the martensitic stainless steel such that the carburized case 26 predominately forms carbides of intermediate stability, such as $M_6C$, $M_2C$, $M_{23}C_6$ or combinations thereof (hereafter "intermediate-stability carbides"). That is, the combined amount of intermediate-stability carbides is greater than the amount of any other types of carbides. The intermediate-stability carbides can subsequently be thermally managed through solution heat treating to thereby avoid the depletion of chromium and maintain the corrosion resistance of the steel article 20 along with other desirable mechanical and tribological properties.

After austenitization heat treatment, the steel article 20 is immediately quenched at a cooling rate that is sufficient to avoid substantial precipitation of any carbides during cool down to the martensite start transformation temperature. In doing so, the core 24, which is essentially the composition of the original martensitic stainless steel, includes at least 8 wt. % chromium and the case 26 maintains at least 8 wt. % chromium in solid solution to thereby avoid or reduce the formation of carbides that deplete the bulk matrix alloy of chromium.

In embodiments, the preselected grain size is ASTM #5 or smaller, and the preselected carbon concentration in the carburized case 26 is less than or equal to 1.75 wt. %. The grain size of the steel article 20 can be determined through known metallurgical methods and standards, such as ASTM E-112. The relatively small ASTM #5 grain size provides a relatively high grain boundary area per unit volume and a corresponding fast diffusion rate of carbon that reduces the risk of saturating the grain boundaries with carbon and forming a variety of coarse carbides, including the high-stability carbides that are undesired for avoiding chromium depletion. Instead, the high grain boundary area per unit volume promotes fast and uniform diffusion of the carbon into the martensitic stainless steel during carburization leading eventually to uniform fine dispersion of carbides in the carburized case region.

The preselected carbon concentration of less than or equal to 1.75 wt. % in the carburized case 26 serves to provide a hardened case structure that is harder than the core 24. An amount of carbon between 0.8 wt. % and up to 1.75 wt. % is sufficient to produce a hard, load-bearing case and also facilitates the avoidance of saturating the grain boundaries with carbon, which could result in the formation of the undesired high-stability carbides and poor corrosion resistance.

The composition of the steel article 20 is also selected to favor the predominant formation of the intermediate-stability carbides. In embodiments, the composition includes X wt. % chromium and Z wt. % molybdenum, where X and Z are variables such that a ratio X/Z is between 1 and 18. In a further example, the ratio X/Z is between 3.0 and 4.7. That is, the selected ratios, in combination with the preselected grain size and preselected carbon concentration, favor the predominant formation of the desired intermediate-stability carbides.

The composition may additionally be selected to include predetermined amounts of other elements that also favor the formation of the intermediate-stability carbides. For instance, the composition may also include $A_1$ wt. % of nickel and $A_2$ wt. % of cobalt, where $A_1$ and $A_2$ are variables such that a ratio $A_1/A_2$ is between 0.3 and 6.2. In a further embodiment, the ratio $A_1/A_2$ is between 0.6 and 2.1. The ratio $A_1/A_2$, in combination with the disclosed ratio of chromium to molybdenum, the preselected grain size, and the preselected carbon concentration further favors the formation of the intermediate-stability carbides that are desired to avoid the depletion of chromium.

In a further example, the composition of the steel article 20 includes chromium, cobalt, molybdenum, nickel and optionally titanium. These elements are in solid solution in the carburized case 26 and a ratio of the amounts of elements of Cr/(Co+Mo+Ni+Ti) is between 1.1 and 1.5. That is, the disclosed ratio of these elements in combination with the preselected grain size and preselected carbon concentration favor the formation of the intermediate-stability carbides that are desired for avoiding or reducing chromium depletion.

The following are additional example nominal compositions, given in weight percent, according to the disclosure.

13Cr-5.4Co-1.8Mo-2.6Ni-0.6Mn-0.6V-0.4Si-0.07C-bal.Fe 13.75Cr-5Co-3Mo-3Ni-0.08V-0.75Mn-0.4Si-0.15C-bal.Fe 14Cr-5Co-4Mo-3.5Ni-0.08V-0.22Mn-0.3Si-0.15C-bal.Fe 13.5Cr-3.75Co-3.5Mo-3Ni-0.08V-0.25Mn-0.3Si-0.15C-bal.Fe 13.5Cr-3.75Co-3.5Mo-3Ni-1Ti-1Mn-0.3Si-0.15C-bal.Fe 15.25Cr-5Co-3.5Mo-4Ni-0.25V-0.2Mn-0.25Si-0.15C-bal.Fe 14Cr-2.75Co-3.25Mo-3.5Ni-0.3V-0.3Mn-0.3Si-0.15C-bal.Fe In embodiments, the steel article 20 generally has a composition as described herein. However, the localized concentrations of elements in solid solution, such as chromium, may vary between the carburized case 26 and the core 24 if the chromium forms some carbides in the carburized case 26. In the illustrated example, the core 24 includes $X_1$ wt. % of chromium in solid solution and the carburized case 26 includes $X_2$ wt. % of chromium such that a ratio of $X_1/X_2$ is between 1.0 and 2.25. Additionally, the difference $X_1$-$X_2$ may be less than 5 and each of $X_1$ and $X_2$ is greater than 8 wt. %.

The prescribed amount of carbon can be introduced into the surface of the steel article 20 using vacuum or plasma-assisted carburization. Gas carburization may also be used but it generally is more difficult to control the diffusion rate of the carbon into the surface and the formation of an oxide layer may be necessary to help control the diffusion rate. However, with the vacuum or plasma assisted carburization, the diffusion rate of carbon is more readily controllable to achieve the desired uniform dispersion of carbon into the surface of the steel article 20.

The prescribed ASTM #5 grain size or smaller may be established through pre-carburization thermo-mechanical processing. For instance, the thermo-mechanical processing may include forging and ring rolling at elevated temperatures to produce the prescribed ASTM #5 grain size. In embodiments, the total reduction is greater than 30% and a processing temperature is between 1700° F. and 1900° F. (926° C.-1038° C.) according to the steel selected.

After the carburization, the martensitic stainless steel work piece is heated to a temperature above its austenization temperature to substantially solution the metal carbides of the intermediate-stability carbides. In embodiments, the temperature is between 1850° F.-1975° F. (1010° C.-1080° C.). In this temperature range, the intermediate-stability carbides dissolve into solid solution. In contrast, high-stability carbides are stable at such temperatures and do not go into solution in the steel matrix. Additionally, the prescribed temperature for heating to solution the metal carbides should not be so high into the austenitic region of the martensitic stainless steel as to produce excessive stable retained austenite upon cooling. In embodiments, the excessive retained austenite is undesired and the prescribed temperatures generally produce less than 14 vol. % of retained austenite.

The steel article 20 may be held at the prescribed temperature for a time that is sufficient to substantially solution the metal carbides and transform the microstructure of the steel article 20 to austenite. However, the time should not be so long as to significantly coarsen the grain size or produce excessive retained austenite. Given this description, one of ordinary skill in the art will recognize suitable times to achieve a desired balance between solutioning the metal carbides, grain coarsening and excessive retained austenite.

The steel article 20 is then immediately quenched at a cooling rate that is sufficient to avoid substantial precipitation of any carbides during cool down to the martensite start temperature. That is, the quenching should be started with minimal delay after the austenization step such that, in total, the prescribed cooling rate avoids the region of the carbide precipitation in the time-temperature-transformation diagram for the given alloy composition used. For a particular composition of martensitic stainless steel, a suitable quenching rate can be determined experimentally through metallurgical evaluation of the grain structure at different cooling rates. In some examples, the steel article 20 is cooled at a rate of approximately 80° F./second or faster to avoid substantial precipitation of any carbides. The avoidance of precipitation of carbides ensures that the carburized case 26 maintains a desired high amount of chromium in solid solution, such as at least 8 wt. % of chromium in solid solution.

In the as-quenched condition, the carburized steel article 20 will contain untempered martensite that is brittle. To relieve the quench stresses and restore toughness to the carburized case 26, the steel article 20 is tempered. The tempering temperature may be a relatively low temperature or a relatively high temperature, depending upon the desired properties of the end-use steel article 20 and desired microstructure. At relatively low tempering temperatures of less than 600° F. (316° C.), the stress is relieved and substantially no precipitation of carbides occurs. In this condition, the steel will have the highest corrosion resistance of the two possible tempering treatments, low versus high.

Alternatively, the steel article 20 can be tempered at a relatively high temperature of approximately 1000° F. (538° C.) to relieve the residual stresses. However, at this high temperature, carbides will form and further harden the carburized case 26. The trade-off of the increased hardness through the precipitation of the carbides is a depletion of chromium from solid solution and a sacrifice of the corrosion resistance of the steel article 20. In general, the steel article 20 may have less than 10 vol. % of carbide precipitates when tempered at the low tempering temperature and up to 40 vol. % of carbide precipitates when tempered at the higher tempering temperature.

The carburization of the steel article 20 in combination with the disclosed compositions of the martensitic stainless steel, preselected carbon concentration in a carburized case 26, and preselected grain size favors the predominant formation of the intermediate-stability carbides. The subsequent heating of the steel article 20 at the austenitization temperature solutions the intermediate-stability metal carbides. Upon cooling of the steel article 20 at a cooling rate that is sufficient to avoid substantial precipitation of any carbides, during cool down to the martensite start temperature the carbon in the carburized case 26 provides a hard load-bearing, high carbon martensite case or shell on the steel article 20 and avoids depleting the bulk alloy matrix of chromium. The chromium thereby substantially remains in solid solution to maintain a high level of corrosion resistance of the steel article 20. The steel article 20 thereby provides a good balance of desired mechanical properties, tribological properties and high corrosion resistance that is needed for bearings, gears or other components that are subjected to corrosive environments.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A steel article comprising:

a martensitic stainless steel body defining a core comprising at least 8 wt % chromium and other alloying additions to preferentially form the intermediate stability carbides selected from a group consisting of $M_6C$, $M_2C$, $M_{23}C$ and combinations thereof, and a carburized case generally surrounding the core, the carburized case including 0.8-1.75 wt % of carbon and at least 8 wt % chromium in solid solution.

2. The steel article as recited in claim 1, wherein the core includes $X_1$ wt. % chromium and the carburized case includes $X_2$ wt. % chromium in solid solution such that a ratio $X_1/X_2$ is between 1 and 2.25.

3. The steel article as recited in claim 2, wherein $X_1-X_2$ is less than 5.

4. The steel article as recited in claim 1, wherein the martensitic stainless steel body comprises a composition including X wt. % chromium and Z wt. % molybdenum wherein X and Z are variable such that a ratio of X/Z is between 1 and 10.

5. The steel article as recited in claim 4, wherein the ratio X/Z is between 3.0 and 4.7.

6. The steel article as recited in claim 1, wherein the carburized case includes 1-1.75 wt % of carbon.

7. The steel article as recited in claim 1, wherein the martensitic stainless steel body has an ASTM grain size #5 or smaller.

8. The steel article as recited in claim 1, wherein the martensitic stainless steel body includes less than 10 vol. % of any carbides.

9. The steel article as recited in claim 1, wherein the martensitic stainless steel body has a composition of chromium, cobalt, molybdenum, nickel and optionally titanium that are in solid solution in the carburized case such that a ratio Cr/(Co+Mo+Ni+Ti), with regard to the amounts of the elements in wt. %, is between 1.1 and 1.5.

* * * * *